United States Patent [19]

Walker

[11] Patent Number: 4,579,678

[45] Date of Patent: Apr. 1, 1986

[54] DETERGENT BLEACH COMPOSITIONS

[75] Inventor: Adrian W. Walker, Irby, Great Britain

[73] Assignee: Lever Brothers Company, New York, N.Y.

[21] Appl. No.: 619,974

[22] Filed: Jun. 13, 1984

[30] Foreign Application Priority Data

Jun. 20, 1983 [GB] United Kingdom ..... 8316760

[51] Int. Cl.[4] ..... C11D 7/54; C11D 3/395; D06L 3/02

[52] U.S. Cl. ..... 252/95; 252/99; 252/102; 252/133; 252/174.14; 252/186.38; 252/186.43

[58] Field of Search ..... 252/95, 99, 133, 186.43

[56] References Cited

U.S. PATENT DOCUMENTS

| | | | |
|---|---|---|---|
| 3,156,654 | 11/1964 | Konecny et al. | 252/186.33 |
| 3,372,125 | 3/1966 | Hill et al. | 252/99 |
| 3,532,634 | 10/1970 | Woods | 252/95 |
| 4,225,452 | 9/1980 | Leigh | 252/102 |
| 4,478,733 | 10/1984 | Oakes | 252/99 |

FOREIGN PATENT DOCUMENTS

| | | |
|---|---|---|
| 0027643 | 4/1981 | European Pat. Off. . |
| 0072166 | 2/1983 | European Pat. Off. . |
| 0082146 | 6/1983 | European Pat. Off. . |
| 82563 | 6/1983 | European Pat. Off. . |
| 141844 | 5/1980 | German Democratic Rep. . |

*Primary Examiner*—Lorenzo B. Hayes
*Assistant Examiner*—John F. McNally
*Attorney, Agent, or Firm*—Milton L. Honig; James J. Farrell

[57] ABSTRACT

Built detergent bleach compositions having improved low temperature bleach performance comprising a sequestrant builder; a peroxyacid selected from peracetic acid, monoperoxyphthalic acid and monopersulphate and water soluble salts thereof; and 0.005 to 0.1% by weight of Manganese (II) ions, in the substantial absence of hydrogen peroxide. The compositions can be used for washing and cleaning fabrics at temperatures below 40° C.

4 Claims, No Drawings

DETERGENT BLEACH COMPOSITIONS

This invention relates to detergent bleach compositions comprising a peroxyacid as the bleach component, which are particularly, but not essentially adapted for fabric washing.

Detergent bleach compositions comprising a peroxyacid are known in the art.

It is also known to incorporate a bleach system comprising a combination of a per-compound such as sodium perborate and a peroxyacid precursor (activator) which forms a peroxyacid in situ. There are definite advantages in using a peroxyacid over said precursor bleach system which only generates the peroxyacid from the reaction of the percompound and the activator in solution, because a peroxyacid perse does not suffer from the relatively low efficiency of peroxyacid generation and bleaching which may be due to a deleterious side reaction taking place between the peroxyacid formed and the percompound in the wash/bleach solution, resulting in lower peroxyacid yields. Bleach systems comprising a per-compound and an activator therefore requires proper peroxyacid stabilising agents which should inhibit said side reaction, such as disclosed in U.S. Pat. No. 4,225,452, in order to achieve a satisfactory peracid yield. However peroxyacid bleaching is poor a temperatures below 40° C.

With the increasing trend of saving energy, housewives are becoming more and more energy-conscious and have gradually changed their washing habit towards lower wash-temperatures. Today a major proportion of housewives are washing also their white laundry using the 60° C. wash-cycle. A considerable saving of energy would be obtained if washing habits could be further shifted towards cooler and cold water washing e.g. below 40° C., also for whites. There is therefore a continuous desire from the part of investigators to find ways of improving the bleaching action of bleach systems.

It is an object of the present invention to improve the bleaching performance of peroxyacids and to provide detergent bleach compositions comprising a peroxyacid having improved bleaching performance at lower temperatures.

It is known that heavy metals under certain conditions can catalyse the bleaching action of hydrogen peroxide compounds. U.S. Pat. No. 3,156,654 discloses the bleach activity improvement of peroxide compounds by using copper or cobalt ions together with a special type of chelating agents, such as pyridine carboxylic acids.

It has now surprisingly been found that in the substantial absence of hydrogen peroxide and in the presence of a sequestrant builder the bleaching performance of certain peroxyacids i.e. peracetic acid, mono-peroxyphthalic acid and monopersulphate, can be improved by the addition of trace levels of manganese (II) ions. Absence of hydrogen peroxide and the presence of a sequestrant builder are essential conditions for the manganese (II) ion to exert its catalysis action on said peroxyacids.

U.S. Pat. No. 3,532,634 discloses bleaching compositions comprising a persalt, an activator, a transition metal and a chelating agent having a first complex formation constant with the transition metal ion of log 2 to about log 10 at about 20° C.

The present invention has the advantage over and is distinct from this system of the art in that it uses a peroxyacid in the absence of hydrogen peroxide, and without the need of said special chelating agent.

The manganese (II) ions added for improving the bleach performance of the peroxyacid according to the invention can be derived from any watersoluble manganese (II) salt, such as manganous sulphate or manganous chloride, or from any manganese compound which delivers manganese (II) ions in aqueous solution.

By trace levels it is meant here manganese (II) ion concentrations in the wash/bleach solution within the range of from about 0.1 to 1 parts per million. These correspond roughly to a manganese (II) ion content in the detergent bleach composition of about 0.005 to 0.1% by weight.

Any sequestrant builder can be used according to the inventon, be it inorganic or organic in nature. An alkalimetal citrate, nitrilotriacetate, ethylenediaminetetra acetate, or an alkalimetal triphosphate may for example be used as the sequestrant builder. A preferred sequestrant builder is sodium or potassium triphosphate.

Accordingly the invention provides a built detergent bleach composition comprising a sequestrant builder, a peroxy-acid selected from the group consisting of peracetic-acid, mono-peroxyphthalic acid, monopersulphate, and water-soluble salts thereof, and from 0.005 to 0.1% by weight of manganese (II) ions in the substantial absence of hydrogen peroxide.

Preferably the manganese (II) compound in the composition is protected against direct contact with the peroxyacid to avoid premature reaction prior to its point of use.

In practice the composition of the invention will comprise from about 5 to 60% by weight of the sequestrant builder.

The amount of peroxyacid i.e. peracetic-acid, monoperoxyphthalic acid or monopersulphate in the composition will normally be in the range of from 1 to 25% by weight, preferably from 2 to 10% by weight.

Preferably the mono-peroxyphthalic acid is used in the form of its stable magnesium salt, such as is described in European Patent Application 0027146 and 0027693 and having the formula:

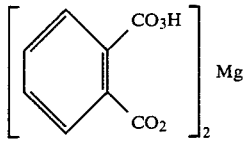

As the monopersulphate, the commercially available potassium monopersulphate is preferably used.

The detergent bleach composition of the invention usually contains a surface active agent, generally in an amount of from about 2% to 50% by weight, preferably from 5–30% by weight. The surface active agent can be anionic, nonionic, zwitterionic or cationic in nature or mixtures of such agents.

Preferred anionic non-soap surfactants are water-soluble salts of alkylbenzene sulphonate, alkyl sulphate, alkylpolyethoxyether sulphate, paraffin sulphonate, alpha-olefin sulphonate, alpha-sulfocarboxylates and their esters, alkylglycerylethersulphonate, fatty acid monoglyceride-sulphates and-sulphonates, alkylphenol-polyethoxy ethersulphate, 2-acyloxy-alkane-1-sulphonate, and beta-alkyloxy alkanesulphonate. Soaps are also preferred anionic surfactants.

Especially preferred are alkylbenzenesulphonates with about 9 to about 15 carbon atoms in a linear or branched alkyl chain, more especially about 11 to about 13 carbon atoms; alkylsulphates with about 8 to about 22 carbon atoms in the alkyl chain, more especially from about 12 to about 18 carbon atoms; alkylpolyethoxy ethersulphates with about 10 to about 18 carbon atoms in the alkyl chain and an average of about 1 to about 12 —$CH_2CH_2O$— groups per molecule, groups per molecule; linear paraffin sulphonates with about 8 to about 24 carbon atoms, more especially from about 14 to about 18 carbon atoms and alpha-olefin sulphonates with about 10 to about 24 carbons atoms, more especially about 14 to about 16 carbon atoms; and soaps having from 8 to 24, especially 12 to 18 carbon atoms.

Water-solubility can be achieved by using alkali metal, ammonium, or alkanolamine cations; sodium is preferred.

Preferred nonionic surfactants are water-soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1 to 30 moles of ethylene oxide with 1 mol of branched or straight chain, primary or secondary aliphatic alcohol having from about 8 to about 22 carbon atoms; more especially 1 to 6 moles of ethylene oxide condensed with 1 mol of straight or branched chain, primary or secondary aliphatic alcohol having from about 10 to about 16 carbon atoms; certain species of poly-ethoxy alcohol are commercially available under the trade-names of "Neodol"®, "Synperonic"® and "Tergitol"®, which are registered Trade Marks.

Preferred zwitterionic surfactants are water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyldimethyl-propanesulphonates and alkyldimethyl-ammoniohydroxypropane-sulphonates wherein the alkyl group in both types contains from about 1 to 18 carbon atoms.

Preferred cationic surface active agents include the quaternary ammonium compounds, e.g. cetyltrimethylammonium-bromide or -chloride and distearyldimethylammonium-bromide or -chloride, and the fatty alkyl amines.

A typical listing of the classes and species of surfactants useful in this invention appear in the books "Surface Active Agents", Vol. I, by Schwartz & Perry (Interscience 1949) and "Surface Active Agents", Vol. II by Schwarz, Perry and Berch (Interscience 1958), the disclosures of which are incorporated herein by reference. The listing, and the foregoing recitation of specific surfactant compounds and mixtures which can be used in the specific surfactant compounds and mixtures which can be used in the instant compositions, are representative but are not intended to be limiting.

In addition thereto the composition of the invention may contain any of the conventional components and/or adjuncts usable in fabric washing compositions.

As such can be named, for instance soil-suspending agents such as water-soluble salts of carboxymethylcellulose, carboxyhydroxymethylcellulose, copolymers of maleic anhydride and vinyl ethers, and polyethylene glycols having a molecular weight of about 400 to 10.000. These can be used at levels of about 0.5% to about 10% by weight. Dyes, pigments, optical brighteners, perfumes, anti-caking agents, suds control agents, fabric softening agents, alkaline agents, stabilizers and fillers can also be added in varying amounts as desired.

The composition of the invention will normally be presented in the form of a solid product, preferably in the form of a solid particulate product which may be prepared by any conventional technique known in the art. e.g. by dry mixing or a combination of spray drying and dry mixing.

If liquid peracetic-acid is used in dry solid particulate composition it will be necessary to encapsulate it or have it adsorbed onto an inert carrier prior to incorporation.

In the following Examples manganous sulphate was used as source of manganese (II) ions.

EXAMPLE I

The following base detergent powder composition was used in the experiments.

| Composition | parts by weight |
|---|---|
| Sodium $C_{12}$ alkylbenzene sulphonate | 6.0 |
| Fatty alcohol condensed with 7 ethylene oxide groups | 2.0 |
| Sodium $C_{16}$-$C_{18}$ fatty acid soap | 3.0 |
| Sodium triphosphate | 30.0 |
| Sodium silicate alkaline 1:2 | 8.0 |
| Sodium carboxymethyl cellulose | 0.33 |
| Tetra sodium ethylenediamine tetraacetate | 0.13 |
| Fluorescer | 0.3 |
| Sodium sulphate | 17.0 |
| Water | 10.0. |

The above base detergent powder composition was dosed at 4 g/l in water and peracetic acid was added at a concentration of $2.67\times10^{-3}$ Mole+catalase (to remove hydrogen peroxide). A series of solutions with and without added metal ions were used for washing/bleaching of tea stained test cloths in a one hour isothermal wash at 25° C.

The bleaching effects achieved on tea-stained test cloths measured as R*460 (reflectance value) were as follows:

TABLE I

| Metal ion | ion concentration (ppm) | ΔR*460 (reflectance value) |
|---|---|---|
| None (control) | — | 6.1 |
| Cobalt (II) | 0.6 | 1.3 |
| Chromium (III) | 0.6 | 6.4 |
| Copper (II) | 0.6 | 6.0 |
| Iron (III) | 0.6 | 6.3 |
| Nickel (II) | 0.6 | 6.0 |
| Manganese (II) | 0.6 | 9.8. |

The above results clearly show the surprising effectiveness of Manganese (II) to improve the bleaching performance of peracetic-acid at 25° C.

All other metals of the above series were ineffective or even detrimental to the bleaching performance of peracetic-acid.

EXAMPLE II

The following base detergent powder composition was prepared and used in the experiments:

| Composition | parts by weight |
|---|---|
| Sodium $C_{12}$—alkylbenzene sulphonate | 6.4 |
| Fatty alcohol condensed with 7 ethylene oxide | 3.0 |
| Sodium $C_{16-18}$ fatty acid soap | 5.0 |
| Sodium triphosphate | 37.0 |
| Sodium silicate alkaline (1:2) | 8.0 |
| Sodium carboxymethyl cellulose | 0.6 |
| Sodium ethylene diamine tetra acetate | 0.13 |
| Fluorescer | 0.4 |
| Sodium sulphate | 5.5 |
| Water | 12.0. |

The above base detergent powder was dosed at 4 g/l in water and peracetic acid was added at a concentration of $2\times10^{-3}$ Mole+catalase (to remove any hydrogen peroxyde present).

The solution with or without added manganese (II) ion (0.6 ppm) was used for washing/bleaching tea-stained test cloths in a 40 minutes isothermal wash at 30° C.

The bleaching results measured as ΔR*460 (reflectance values) at different pH's are shown in the following table II.

TABLE II

| pH | ΔR*460 (reflectance value) without Mn (II) | with Mn (II) |
|---|---|---|
| 7.8 | 12.3 | 13.7 |
| 8.4 | 11.3 | 14.4 |
| 9.0 | 6.5 | 12.1 |
| 9.6 | 3.7 | 8.2 |
| 10.1 | 2.7 | 6.6 |
| 10.6 | 2.5 | 5.4 |

The improved bleaching effect by Manganese over the whole pH range tested and particularly at the higher pH range is evident.

EXAMPLE III

The same base powder composition of Example II was used with Magnesium monoperoxyphthalate added at $2\times10^{-3}$ Mole in a 40 minutes isothermal washing experiment at 30° C. with or without 0.6 ppm Manganese (II) added.

The results are shown in the following tabel III.

TABLE III

| pH | ΔR*460 (reflectance value) no $Mn^{2+}$ | with $Mn^{2+}$ |
|---|---|---|
| 8.3 | 3.0 | 3.0 |
| 9.0 | 2.0 | 2.6 |
| 9.3 | 1.2 | 4.0 |
| 9.6 | 1.2 | 4.0 |
| 10.1 | 1.0 | 1.6 |
| 10.7 | 0.8 | 1.5. |

EXAMPLE IV

The experiments were repeated with Potassium monopersulphate to show the following results:

TABLE IV

| pH | ΔR*460 (reflectance value) no $Mn^{2+}$ | with $Mn^{2+}$ |
|---|---|---|
| 8.9 | 2.0 | 2.2 |
| 9.4 | 1.7 | 2.4 |
| 10.0 | 1.6 | 2.7 |
| 10.4 | 1.4 | 2.6. |

In contrast to the above, other peroxyacids i.e. (1) diperoxydodecanoic acid, (2) diperisophthalic acid and (3) diperoxyazelaic acid, tested under the same conditions did not appear to be catalysed by Manganese to a substantial degree.

EXAMPLE V

This example shows the effect of $H_2O_2$ (from sodium perborate) on Manganese catalysis of peroxyacid bleaching. The following detergent base power composition was used in the experiments.

| Composition | Parts by weight |
|---|---|
| Sodium $C_{12}$ alkylbenzene sulphonate | 6.0 |
| Fatty alcohol condensed with 7 ethylene oxide groups | 2.0 |
| Sodium $C_{16}$-$C_{18}$ fatty acid soap | 3.0 |
| Sodium triphosphate | 30.0 |
| Sodium silicate alkaline 1:2 | 8.0 |
| Sodium carboxymethyl cellulose | 0.33 |
| Tetra sodium ethylenediamine tetraacetate | 0.13 |
| Flurorescer | 0.3 |
| Sodium sulphate | 17.0 |
| Water | 10.0 |

The above base powder composition was dosed at 4 g/l in water and monoperoxyphthalic acid (as Mg-salt) was added at a concentration of $2\times10^{-3}$ moles. A series of solution with and without added Manganese and Perborate were used for washing/bleaching of tea-stained test clothes in a one hour isothermal wash test at 30° C. and pH 9.8.

The bleaching results measured as ΔR*460 (reflectance value) were as follows:

| | ΔR*460 |
|---|---|
| 1. Mono-peroxyphthalic acid alone | 1.0 |
| 2. Mono-peroxyphthalic acid + $Mn^{2+}$ (0,6 ppm) | 2.3 |
| 3. Mono-peroxyphthalic acid + perborate (0,5 g/l) | 1.3 |
| 4. Mono-peroxyphthalic acid + perborate + $Mn^{2+}$ | 1.3 |

The detrimental effect of sodium perborate ($H_2O_2$) on Manganese catalysis of mono-peroxyphthalic acid is evident.

EXAMPLE VI

This example shows the effect of a picolinic acid chelating agent on Manganese catalysis of mono-peroxy phthalic acid bleaching The same base powder composition of Example V was used in the experiments at a dosage of 4 g/l and mono-peroxy phthalic acid (as Mg-salt) was added at a concentration of $2\times10^{-3}$ molar.

Using the same washing conditions as in Example V the results of bleaching tests on tea-stained cloths were as follows:

| Bleaching system | ΔR*460 |
|---|---|
| Mono-peroxyphthalic acid + $Mn^{2+}$ (0.6 ppm) | 2.3 |
| Mono-peroxyphthalic acid + $Mn^{2+}$ (0.6 ppm) + picolinic acid ($10^{-4}$M) | 2.4 |

The above results show that picolinic acid as proposed in the art has no effect whatsoever on the bleaching performance of Manganese activated mono-peroxyphthalic acid.

I claim:

1. A built detergent bleach composition comprising (I) from about 2 to 50% by weight of a surface active agent, selected from the group consisting of anionic, nonionic, zwitterionic and cationic detergents, and mixtures thereof;

(II) from 5 to 60% by weight of a sequestrant builder;

(III) from 1 to 25% by weight of a peroxy acid compound selected from the group of peracetic acid, mono-peroxyphthalic acid, monopersulphate and water-soluble salts thereof; and (IV) from 0.005 to 0.1% by weight of Manganese (II) ions; the composition being substantially free of hydrogen peroxide.

2. A detergent bleach composition according to claim 1, wherein said sequestrant builder is sodium or potassium triphosphate.

3. A detergent bleach composition according to claim 1, wherein said mono-peroxy phthalic acid is present in the form of its magnesium salt.

4. A detergent bleach composition according to claim 1, wherein said monopersulphate is present in the form of potassium monopersulphate.

* * * * *